US006739776B2

(12) United States Patent
Hinson

(10) Patent No.: US 6,739,776 B2
(45) Date of Patent: May 25, 2004

(54) FLEXIBLE PAPER GUIDE

(76) Inventor: Victor H. Hinson, 2651 W. Edgefield Rd., Florence, SC (US) 29501

( * ) Notice: Subject to any disclaimer, the term of this patent is extended or adjusted under 35 U.S.C. 154(b) by 0 days.

(21) Appl. No.: 10/241,716

(22) Filed: Sep. 12, 2002

(65) Prior Publication Data

US 2003/0099500 A1 May 29, 2003

Related U.S. Application Data

(60) Provisional application No. 60/333,740, filed on Nov. 29, 2001.

(51) Int. Cl.[7] ..... B41J 13/10

(52) U.S. Cl. ..... 400/599.1; 400/611; 400/88; 248/560

(58) Field of Search ..... 400/599.1, 625, 400/693, 611, 88; 271/3.01, 203; 248/560

(56) References Cited

U.S. PATENT DOCUMENTS

| | | | | |
|---|---|---|---|---|
| 2,802,558 A | | 8/1957 | Wexler | |
| 3,333,671 A | | 8/1967 | Rhode | |
| 4,795,282 A | | 1/1989 | Bradam | |
| 4,849,612 A | | 7/1989 | Stahre | |
| 5,301,915 A | * | 4/1994 | Bahniuk et al. | 248/452 |
| 5,680,166 A | * | 10/1997 | Nishiberi | 347/108 |
| 6,033,392 A | * | 3/2000 | Frey et al. | 604/403 |
| 6,582,139 B2 | * | 6/2003 | Abe et al. | 400/599.1 |

FOREIGN PATENT DOCUMENTS

GB 2 142 879 A 1/1985

* cited by examiner

*Primary Examiner*—Andrew H. Hirshfeld
*Assistant Examiner*—Dave A. Ghatt
(74) *Attorney, Agent, or Firm*—Richard C. Litman

(57) ABSTRACT

A flexible guide for paper sheets exiting the outlet slot of office equipment. The flexible paper guide is easily attachable to a variety of office equipment, which, ordinarily, do not have sheet paper guides. After being attached to the desired office equipment surface, the flexible guide extends over a roll of unprinted material keeping the unused material clean and preventing the printed material from re-coiling and re-entering the material inlet slot. The flexible paper guide has an attachment layer for fastening the guide to the upper surface of the desired office equipment, and is made from a flexible material. The flexible material causes the flexible and tensioned guide to bend, which produces a low angle between the plane of the flexible material guide and the plane of the upper surface of the equipment.

15 Claims, 10 Drawing Sheets

FLEXIBLE PAPER GUIDE

CROSS-REFERENCE TO RELATED APPLICATION

This application claims the benefit of U.S. Provisional Patent Application Serial No. 60/333,740, filed Nov. 29, 2001.

BACKGROUND OF THE INVENTION

1. Field of the Invention

The present invention relates to guides, and more particularly to a flexible sheet device which is an easily attachable and interchangeable guide for printed sheets exiting the outlet slots of different types of office equipment, which usually do not have integrated sheet guides.

2. Description of Related Art

The conventional art depicts a variety of non-interchangeable sheet guides designed for specific types of equipment which generally fall into two categories: 1) paper type guides mechanically fastened through hinge type pins or anchored to specifically shaped receiving slots; or 2) paper outlets of office equipment, shaped and functionally configured to hold exiting paper in a specific orientation in relation to the unprinted paper for minimizing interference with the unprinted paper. In contrast to the conventional art, the present invention is designed to be interchangeable and capable of attachment to a variety of office equipment not configured with built-in guides or specifically shaped paper outlets.

In the first category, U.S. Pat. No. 3,333,671, issued to Karl H. Rhode on Aug. 1, 1967, describes a paper guide mechanically fastened by pins or pivots to the piece of office equipment. Rhode does not disclose an interchangeable and flexible material guide that can be attached via an attachment or adhesive layer to a variety of office equipment.

Similarly, U.S. Pat. No. 4,849,612, issued to Helge Stahre on Jul. 18, 1989, describes an apparatus for viewing a large number of entries on a sheet of paper leaving a calculating machine. The apparatus connects or anchors to the calculating machine by fitting in a track of the calculating machine, and utilizes an elongated fastening device. Stahre does not disclose an interchangeable and flexible material guide that can be attached via an attachment or adhesive layer to a variety of office equipment.

U.K. Patent Application No. GB 2142879 A, published on Apr. 9, 1984, for Naoyuki Maruyama, describes a paper guide adapted for use in an apparatus for producing a record. The paper guide is specifically shaped and mechanically fastened through a hinge pin to the recording apparatus. The patent application does not disclose an interchangeable and flexible material guide that can be attached via an attachment or adhesive layer to a variety of office equipment.

Further, U.S. Pat. No. 2,802,558, issued on Aug. 13, 1957, to Mark Wexler describes magnetic alignment elements for continuous form typewriters or machines. The Wexler alignment elements are two separate tabs which attach to a carriage of a typewriter to keep the forms fed through the typewriter from moving laterally due to the drag exerted by the reciprocal motion of the carriage. The alignment elements are anchored to the typewriter through a combination of metallic attraction and use of a pressure sensitive adhesive layer. Wexler does not disclose a one-piece interchangeable and material flexible guide that can be attached via an attachment or adhesive layer to a variety of office equipment. As a result, the structure of the specifically designed Wexler typewriter alignment tabs cannot be used to keep printing material or paper from recoiling, inking unused rolls of printing material, or keeping debris out of a printing material inlet slot of various pieces of office equipment.

U.S. Pat. No. 4,795,282 issued Jan. 3, 1989, to William R. Bradham on describes a paper guide and stop for a multi-functional printer. The paper guide is attached by screws, rivets or adhesives to a stop block integrated into the multi functional printer. The paper guide is structurally designed to work in conjunction with a specifically shaped path or track for a paper slip or recorded media integrated into the multifunction printer. This combination of components restrains the movement of the paper slip and prevents interference of the paper slip or recorded media with a movable printhead, which moves in a reciprocating motion perpendicular to the path of the paper slip or recording media. Bradham, therefore, does not disclose a one-piece interchangeable and flexible material guide that can be attached via an attachment or adhesive layer to a variety of office equipment. As a result, the structure of the specifically designed and shaped Bradham paper guide and slip stop cannot be used to keep printing material or paper from re-coiling, inking unused rolls of printing material or keeping debris out of a material inlet slot of various pieces of office equipment.

None of the above inventions and patents, taken either singly or in combination, is seen to describe the instant invention as claimed. Thus a flexible paper guide solving the aforementioned problems is desired.

SUMMARY OF THE INVENTION

The present invention is a flexible guide for printing material exiting the material outlet slot of office equipment. The flexible guide is easily interchangeable and attachable to a variety of office equipment, which, ordinarily, do not have specifically configured and integrated guides. Upon attachment to the equipment surface, the guide extends over the roll of unused printing material keeping the unused material clean, and preventing the printed material from recoiling and reentering the material inlet slot. The guide specifically incorporates an attachment layer for attachment to the equipment's upper surface. The guide is made from flexible material, such as vinyl, which produces an angle generally less than 45° between the planes of the guide and the upper surface of the equipment, to minimize debris and printed material from reentering the material inlet slot of the equipment.

Accordingly, it is a principal object of the invention to provide a flexible material guide that is interchangeable and attaches to a variety of office equipment that ordinarily do not have integrated material guides.

It is another object of the invention to flex and prevent a ribbon of printing material exiting an outlet slot from rolling back into the material inlet slot.

It is a further object of the invention to keep debris and torn printing material from entering the material inlet slot.

Still another object of the invention is to provide an easily removable invention which is capable of attaching to a variety of office equipment with printing material supplies.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
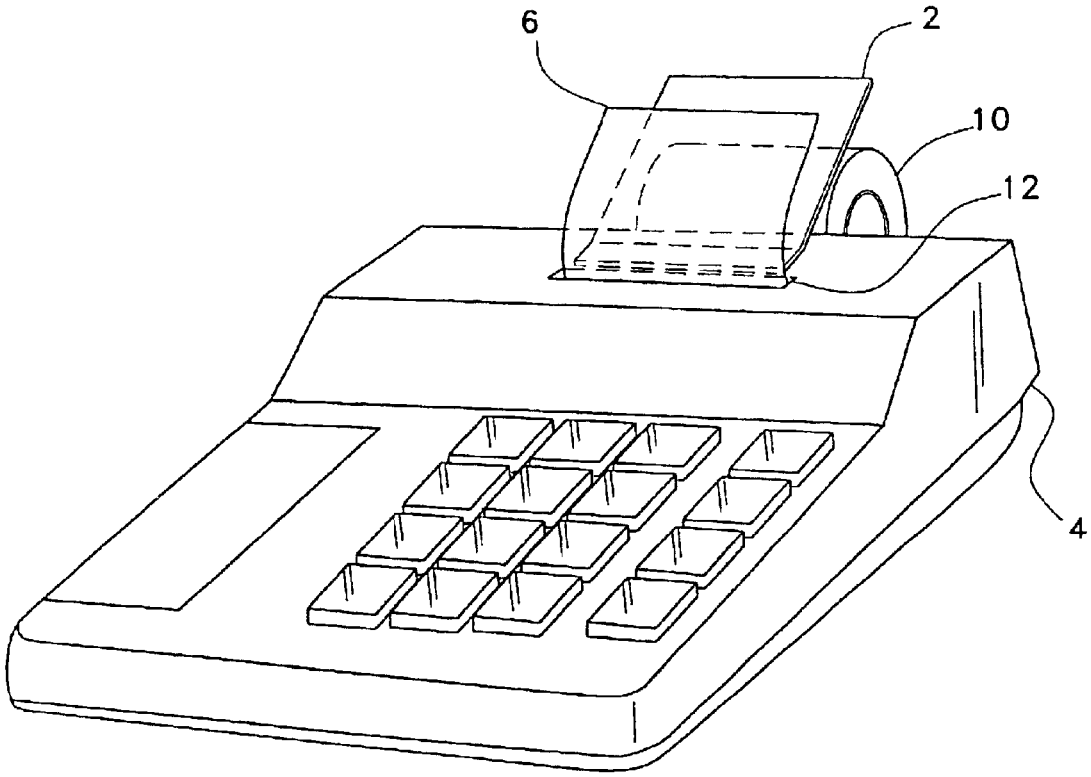
FIG. 1 is an environmental, perspective view of a flexible and interchangeable sheet guide added to a calculating office machine according to a first embodiment of the present invention.
Figure 9:
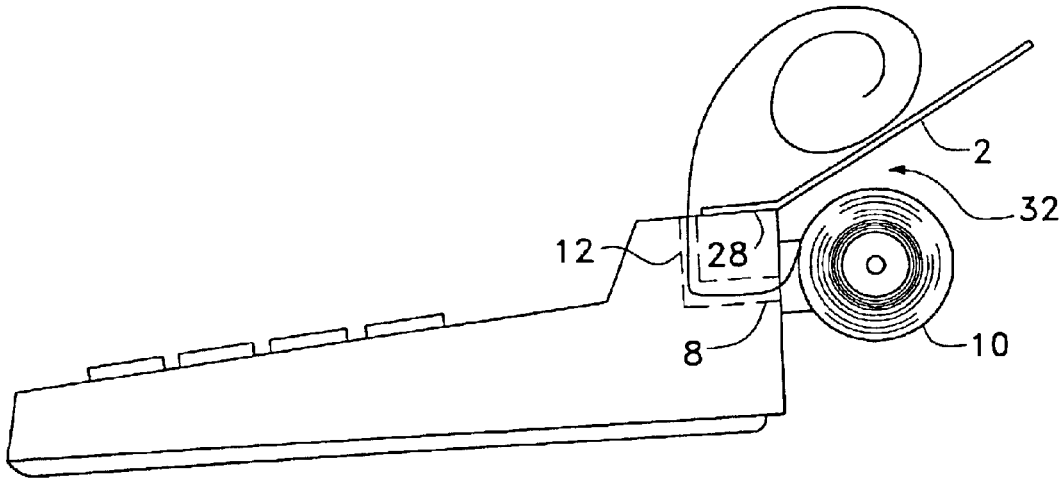
FIG. 9 is a side elevational view of a flexible sheet guide of the first embodiment being used on an office machine to show the prevention of the curled exiting tape snagging.

A first embodiment of the present invention in FIG. 1 is a removable, elongated, flexible, tensioned sheet guide 2 used to prevent a paper tape or sheet 6 from the tape roll 10 exiting from a tape outlet slot 12 of an office equipment or machine 4, such as an adding or calculating machine, from rolling back into a tape inlet slot 8 of the machine 4 as shown clearly in FIG. 9. The flexible sheet guide 2 further keeps debris as well as torn printing material out of the tape inlet slot 8 (FIG. 9) of the adding machine 4.

The flexible sheet guide 2 is capable of being attached to other types of office equipment, including printers, facsimile machines, calculators, tape machines, tape dispensers, and credit card machines, which do not have or use removable, flexible sheet guides. In a preferred, exemplary first embodiment, the flexible sheet guide 2 is fastened to an adding machine 4 to prevent the printed tape or sheet 6 from rolling back into the tape inlet slot 8 (FIG. 9) and further protect the unused roll of printing material 10 from being wet by the ink on the paper tape or sheet 6.

Figure 2:
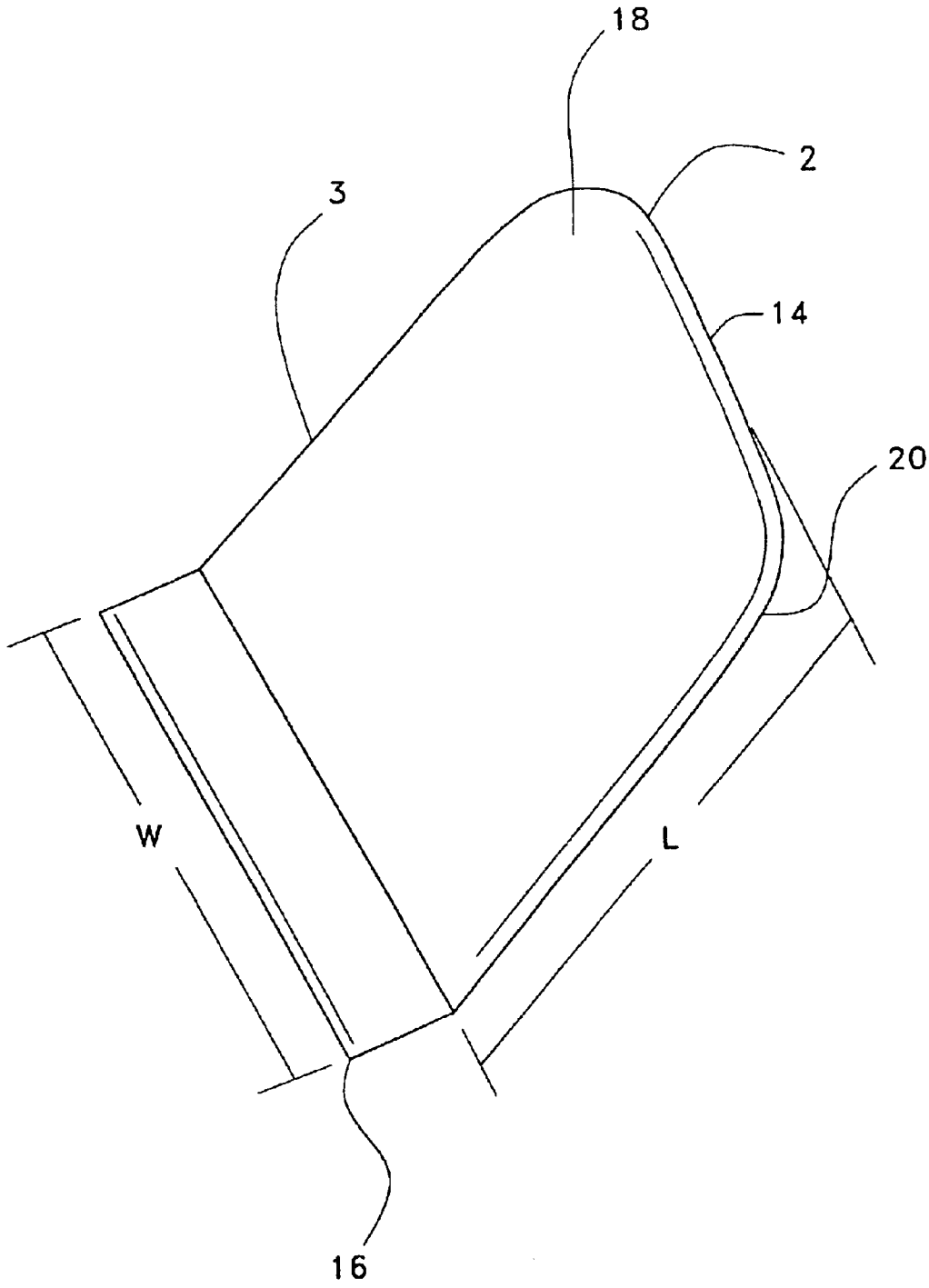
FIG. 2 is a top perspective view of a flexible sheet guide.

The flexible sheet guide 2 in FIG. 2 can have a variety of shapes. In a preferred first embodiment, the flexible sheet guide 2 is rectangular in shape with a width W approximately equivalent to the width of the paper sheet or tape 6 exiting from the sheet outlet slot 12 of the office machine 4. The bottom end portion 16 is bent upwards. The sheet is a printable material upon which ink is deposited. The sheet material is usually made of paper, plastic, paper composites, plastic composites, and the like. The flexible sheet guide 2 has a length L of a straight planar side 3 capable of supporting the roll of material 10 so that the printed sheet 6 does not coil back into the sheet input slot 8 (FIG. 9), ink the roll of material 10, or allow dust, torn material and other debris from entering the sheet input slot 8.

Figure 3:
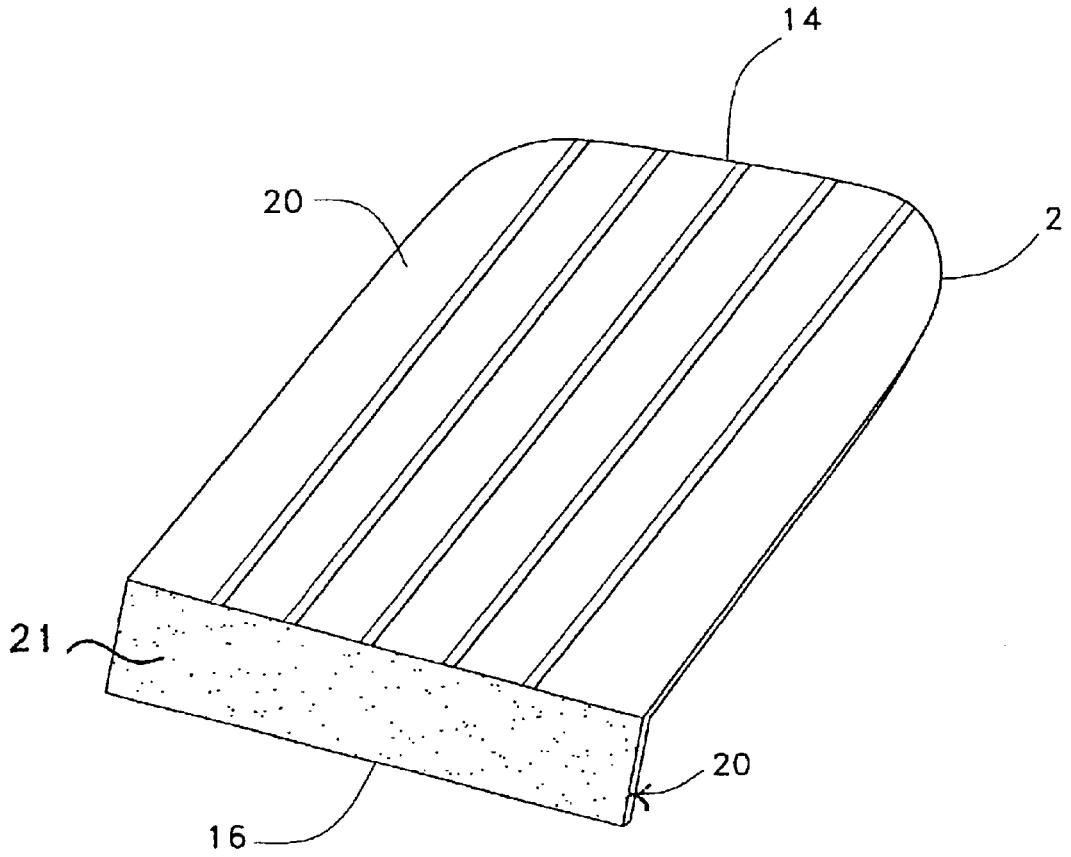
FIG. 3 is a bottom perspective view of a flexible sheet with longitudinal parallel guide ribs.

Structurally, the elongated, flexible, tensioned material guide 2, has a top end portion 14, a bent bottom end portion 16, a front or top side 18, and a rear side 20. In FIG. 3, an attachment layer 21 is shown located on the rear side 20 of the bottom end portion 16.

Figure 4A:
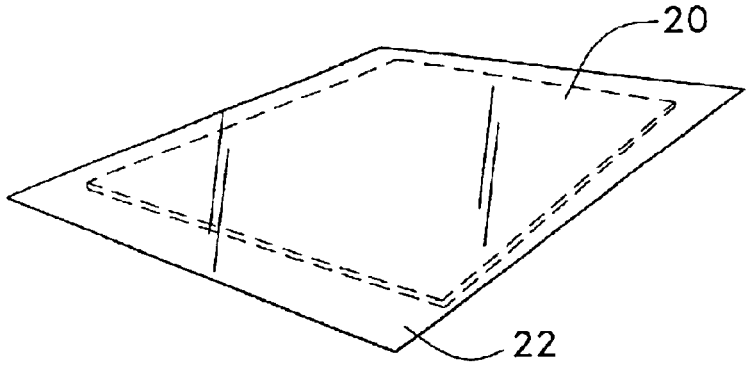
FIG. 4A is a perspective view of an attachment layer and its release liner according to a second embodiment of the present invention.
Figure 4B:
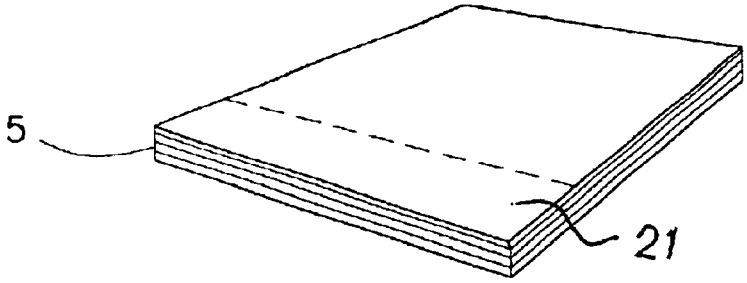
FIG. 4B is a perspective view of stacked, flexible sheet guides according to the second embodiment.

In FIG. 4B, the rectangular attachment layer 21 is at least a single layer, and can have a variety of configurations other than being rectangular. A rectangular release liner sheet 22, shown in FIG. 4A, having a larger overlapping size is located on the attachment layer 21, preventing the attachment layer from accidentally contacting and fastening the flexible sheet guide 2 to undesired surfaces.

Figure 4C:
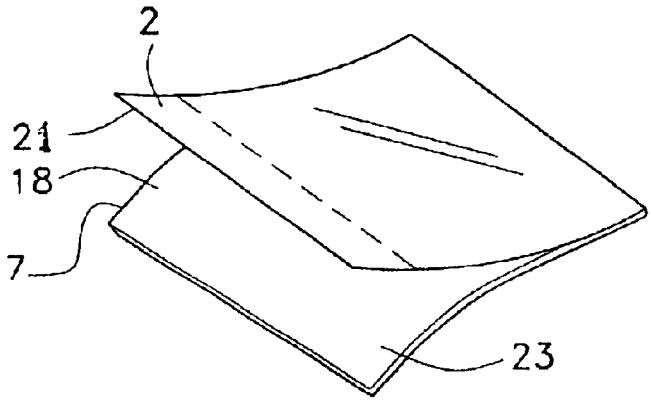
FIG. 4C is a perspective view of a flexible sheet guide of the second embodiment protected on its bottom by a release liner.
Figure 5:
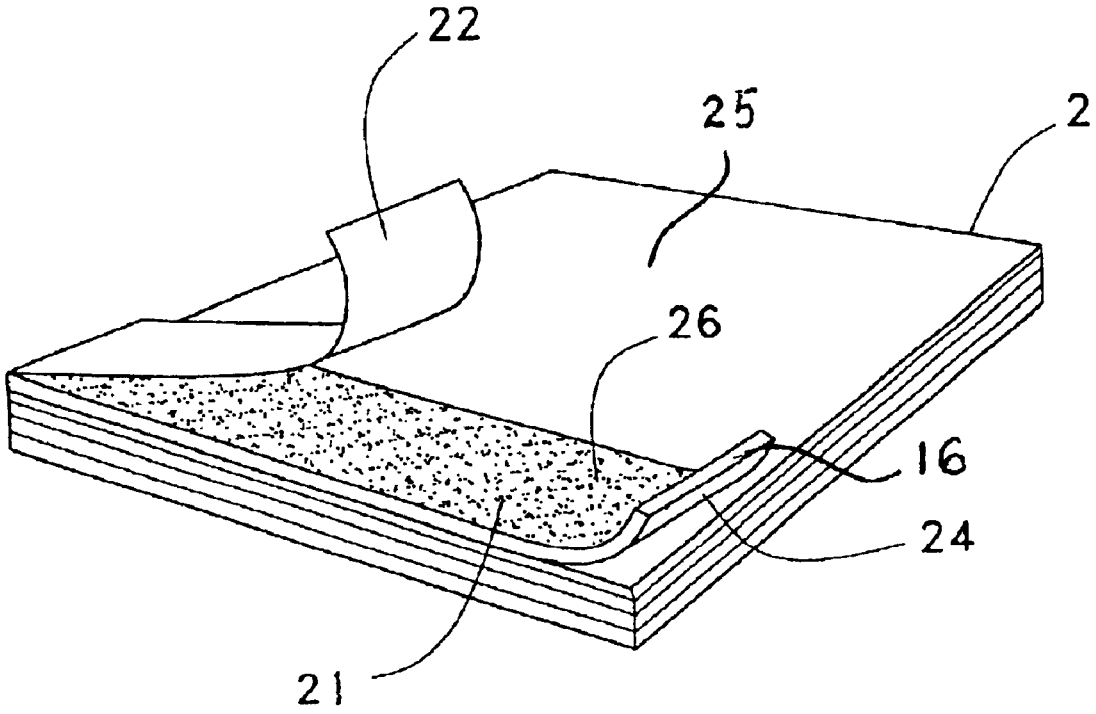
FIG. 5 is a perspective view of an attachment layer as a third embodiment of the present invention.

In five different embodiments, the release liner sheet 22 is a separate single layer as in FIG. 4A (second embodiment) and a smaller sized release liner sheet 22 in FIG. 5 (fifth embodiment), or a plurality of flexible sheet guides 5 (third embodiment) with the bottom attachment layers 21 as in FIG. 4B, or a single sheet guide 7 as shown in FIG. 4C (fourth embodiment), wherein the top surface or side 18 of an underlying flexible sheet guide 7 acts as a release liner 23 for the attachment layer 21 on the rear bottom edge of the flexible sheet guide 2 located on top of the underlying flexible sheet guide 7.

Figure 6:
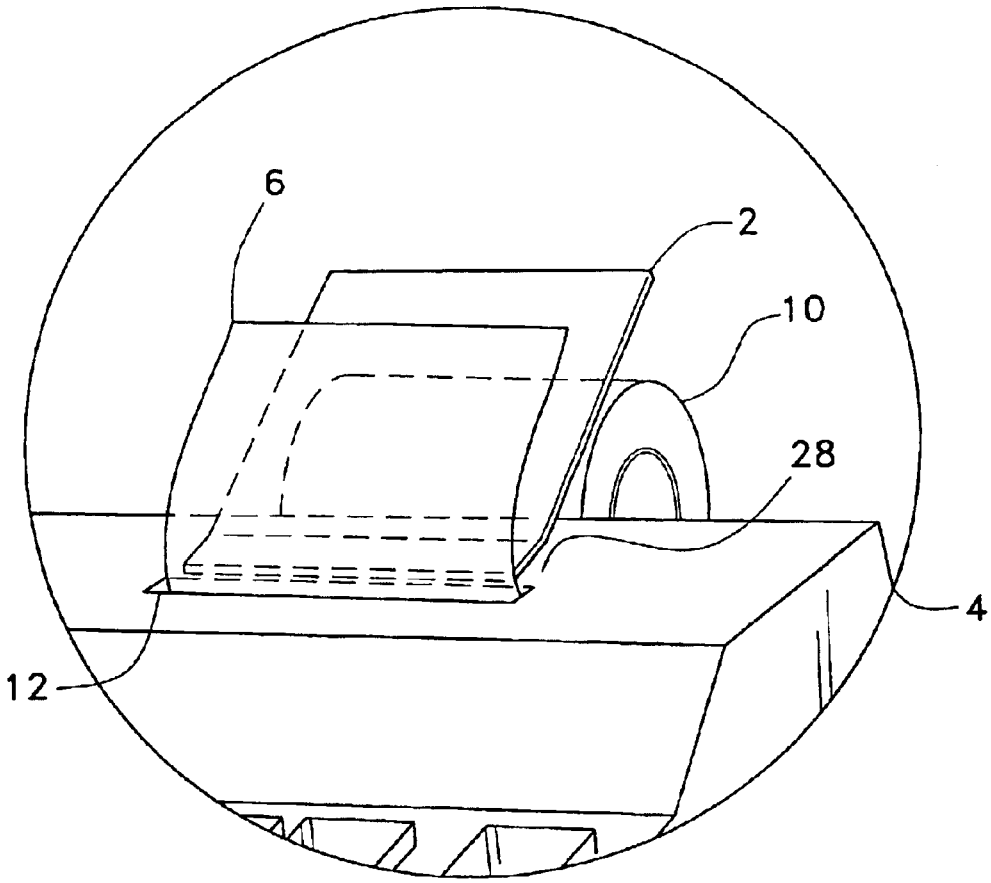
FIG. 6 is a partial perspective view of an upper surface of an office machine of FIG. 1 with the added flexible sheet guide.

In a preferred embodiment in FIG. 5, the attachment layer 21 is a conventional double-sided sticky adhesive strip having a top surface 24 and a bottom surface 26, using the same adhesive material. The bottom surface 24 of the attachment layer 21 is fastened by contact of the adhesive material to the bottom surface 25 of the bottom end portion 16 of one planar flexible sheet guide 2. In FIG. 5, the upturned portion of the bottom end portion 16 is strictly for illustration purposes. Upon removal of the release liner 22, the top surface 26 of the attachment layer 21 is fastened as shown in FIG. 6 to an upper surface portion 28 of an area adjacent or behind the tape outlet slot 12 of the office machine 4. In this embodiment, the same adhesive material is used for the bottom surface 24 and the top surface 26.

In an alternate embodiment, the bottom surface 24 and second surface 26 of the double sided attachment layer 20 can use different adhesives or attachment means.

For example, the bottom surface 24 can use an adhesive glue for attachment and the top surface 26 can use a hook or loop fastening strip for fastening surface 26. In another embodiment, the attachment layer 21 is a single layer of adhesive or attachment material instead of two surfaces and uses a release liner 22. In still another embodiment, different adhesives can be used obviating the need for the release liner 22.

Figure 7:
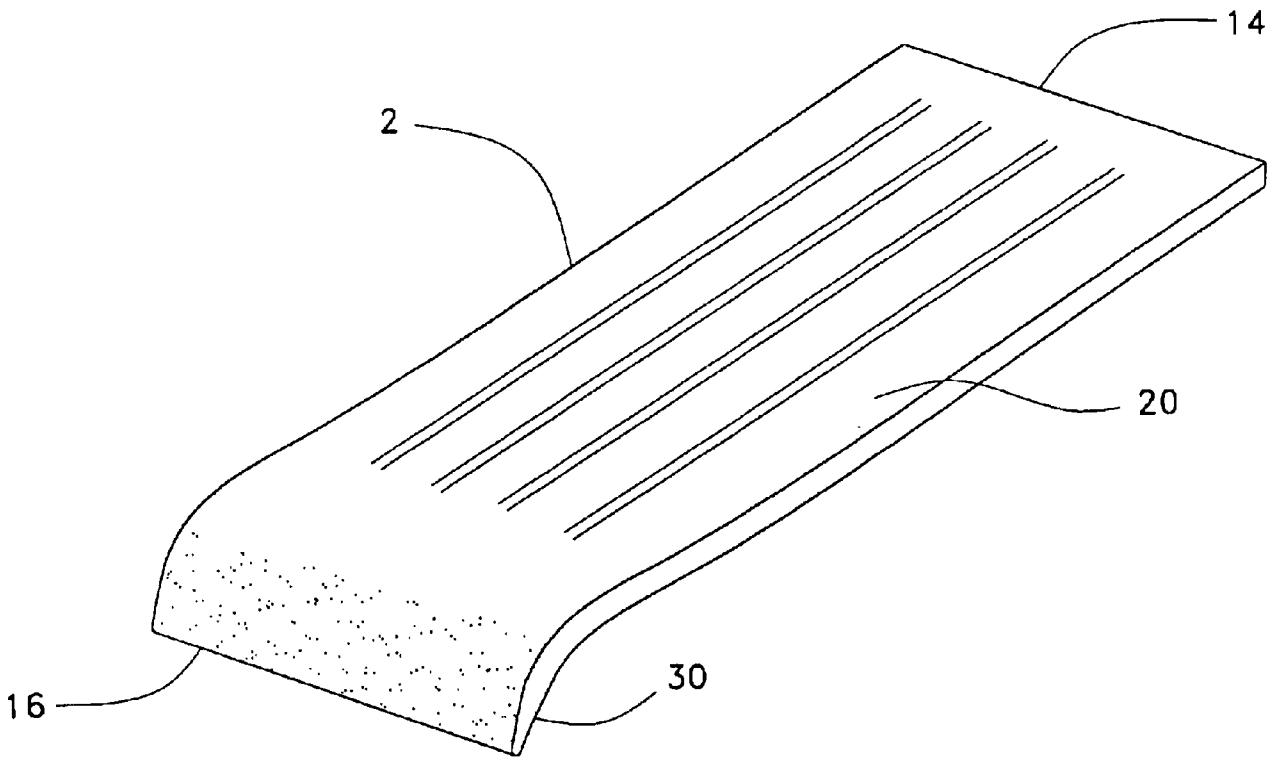
FIG. 7 is a perspective bottom view of a fourth embodiment of a flexible sheet guide having an arcuate bottom end portion.

In a preferred embodiment, when the release liner 22 is removed, the attachment layer 21 is pressed against the top surface 28 of the office machine 4 to activate the adhesive. In a preferred embodiment as shown in FIG. 7, the bottom end portion 16 is a curved and tapered end portion 30, and at an angle so that a flush fit is formed with the top surface 28, thereby reducing the possibility of impeding the exiting paper tape or sheet 6.

Figure 8:
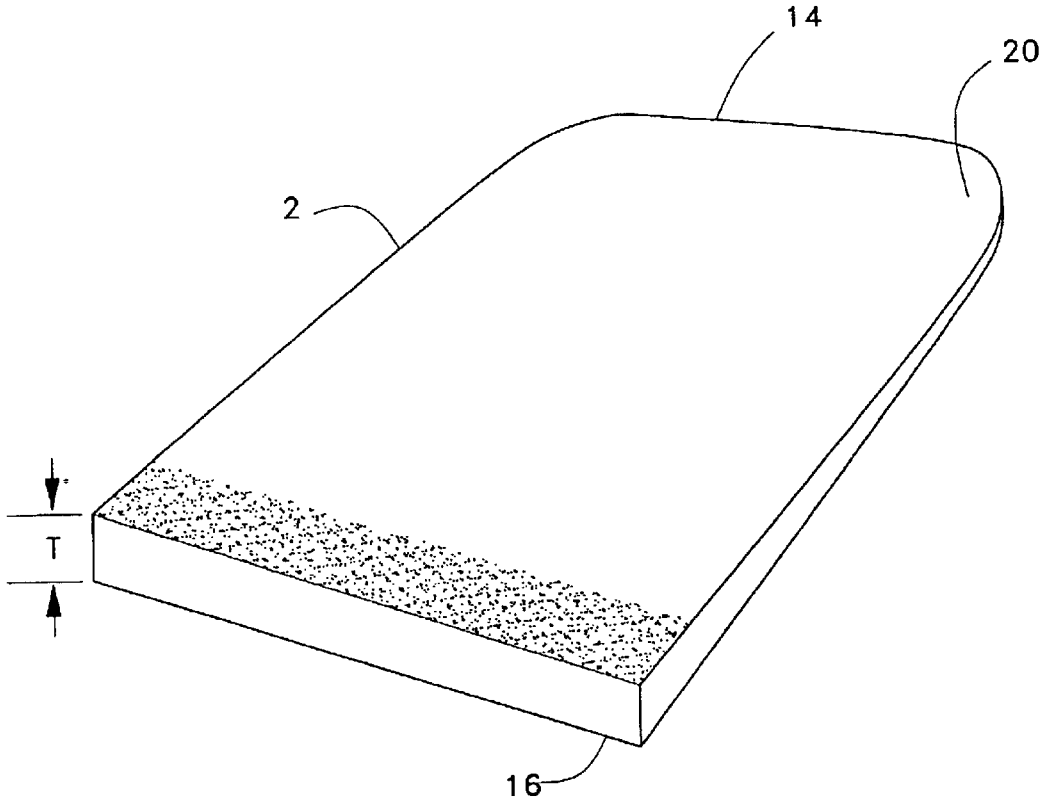
FIG. 8 is a perspective bottom view of a fifth embodiment of a flexible planar sheet guide having a straight bottom end portion and having the thickness thereof decreasing to the top end portion.

In a further embodiment as shown in FIG. 8, the bottom end portion 16 is not tapered, but of a thickness T obviating the need for a tapered end 30.

Figure 10:
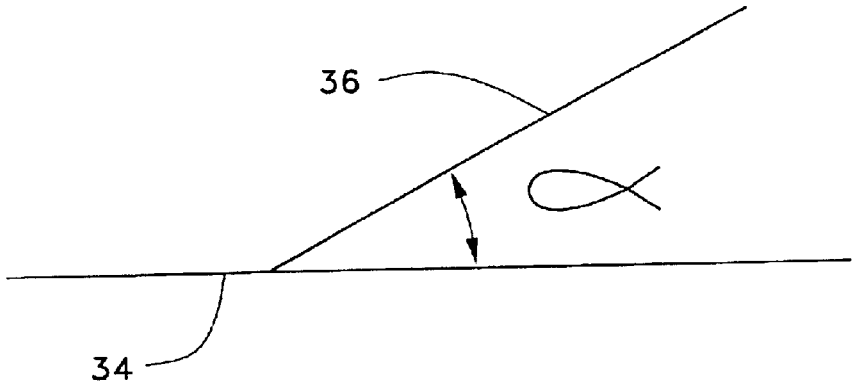
FIG. 10 is a schematic side view of the angle between a flexible sheet guide and an upper surface of an office machine.

The flexible sheet guide 2 is made from a flexible, tensioned material which permits the guide 2 as shown in FIG. 9 to flex primarily downward when paper tape or sheet 6 exiting from the material outlet slot 12 momentarily rests on the flexible sheet guide 2. The downward motion of the flexible sheet guide 2 reduces any space 32 formed between the backside 20 of the flexible sheet guide 2 and the roll of paper tape 10 thereby keeping the paper tape or sheet 6 from touching the roll of paper tape 10 and reducing the chance that the exiting paper tape or sheet 6 can fall or curl back into the path of the paper entering the tape inlet slot 8. The result as shown in FIG. 10 is the formation of a low inner angle, alpha, of generally 45° or less between the plane 34 of the upper surface 28 of the office machine 4 and the plane 36 of the attached flexible sheet guide 2 due to the use of flexible and tensioned materials as well as attachment location. In contrast, the guides of the conventional art generally form much higher angles and, in some instances, closer to 70°. These large angles in conjunction with the suggested use of rigid materials in the conventional art does not minimize reentry of material into the material inlet or prevent marking of the unused roll of material.

Further, the flexible, tensioned sheet guide 2 is made from a variety of flexible materials, including different plastics, vinyls, polymers, plastic composites, paper, paper composites, flexible metals, and other flexible substances. In a preferred embodiment, the tensioned sheet guide 2 is made of a flexible vinyl.

Figure 11:
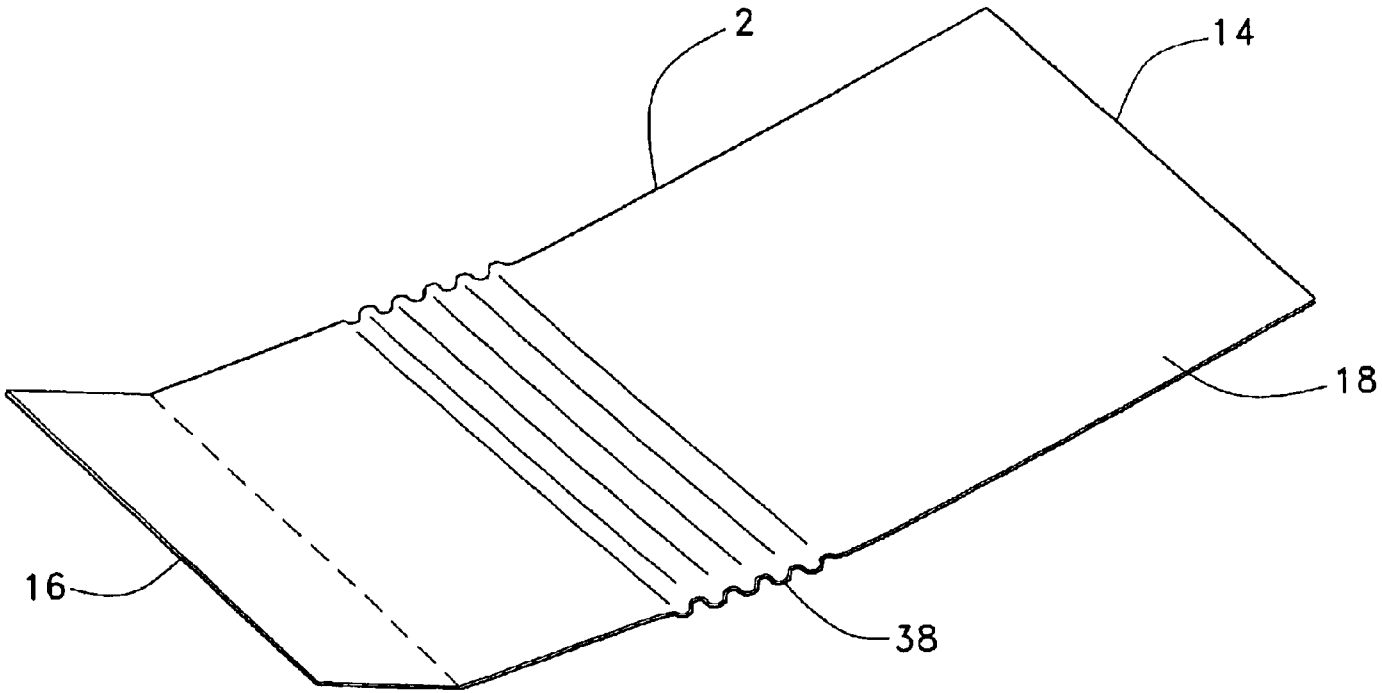
FIG. 11 is a perspective view of a third embodiment of a flexible sheet guide with a flexible corrugated section.

In an alternate embodiment as shown in FIG. 11, the flexible sheet guide 2 has a flexible joint 38 with a ribbed or a corrugated configuration, which can be displaced allowing for adjustment of the alpha angle of the plane 36 of the flexible sheet guide 2 in relation to the plane 34 of the top surface 28 of the office machine 4.

It is to be understood that the present invention is not limited to the embodiments described above, but encompasses any and all embodiments within the scope of the following claims.

I claim:

1. A flexible paper guide for office equipment, comprising:

a) an elongated, flexible sheet guide having a top end portion, an opposed bottom end portion, a front side, a back side, and an attachment layer, wherein the back side above the attachment layer has spaced parallel ribs;

b) said attachment layer being attached to said opposed bottom end portion for fastening said guide to an upper surface of a selected office equipment;

c) said front side being adapted for moveable contact with a ribbon of material;

whereby said elongated, flexible sheet guide fastened to said selected office equipment prevents a ribbon of material exiting from a material outlet slot of said selected office equipment from rolling back into the material inlet slot of said selected office equipment, and keeps debris and torn material out of said material inlet slot.

2. The flexible paper guide according to claim 1, wherein said elongated, flexible sheet guide is made from elastic materials selected from the group consisting of vinyl polymers, non-vinyl polymers, flexible metallics, paper, and paper composites.

3. The flexible paper guide according to claim 1, wherein the sheet guide is made of vinyl.

4. The flexible paper guide according to claim 1, wherein the opposed bottom end portion has a limited bent region.

5. The flexible paper guide according to claim 1, wherein the flexible sheet guide has a thickness increasing from the top end portion to the opposed bottom end portion.

6. The flexible paper guide according to claim 1, wherein the bottom end is arcuate.

7. The flexible paper guide according to claim 1, wherein the main sheet guide portion is inclined approximately 45° from the bottom end portion.

8. A flexible paper guide on an office equipment, comprising:

a) a selected office equipment;

b) an elongated, flexible sheet guide having a top end portion, an opposed bottom end portion, a front side, a back side having a plurality of corrugations, and an attachment layer;

c) said attachment layer being attached to said opposed bottom end portion for fastening said guide to an upper surface of the selected office equipment; and d) said front side being adapted for moveable contact with a ribbon of material;

whereby said elongated, flexible guide fastened to said selected office equipment prevents a ribbon of material exiting from a material outlet slot of said selected office equipment from rolling back into the material inlet slot of said selected office equipment, and keeps debris and torn material out of said material inlet slot.

9. The flexible paper guide according to claim 8, wherein said elongated, flexible sheet guide is made from elastic materials selected from the group consisting of vinyl polymers, non-vinyl polymers, flexible metallics, paper, and paper composites.

10. The flexible paper guide according to claim 8, wherein the sheet guide is made of vinyl.

11. The flexible paper guide according to claim 8, wherein the opposed bottom end portion has a limited bent region.

12. The flexible paper guide according to claim 8, wherein the flexible sheet guide has a thickness increasing from the top end portion to the opposed bottom end portion.

13. The flexible paper guide according to claim 8, wherein the back side above the attachment layer has spaced parallel ribs.

14. The flexible paper guide according to claim 8, wherein the bottom end is arcuate.

15. The flexible paper guide according to claim 8, wherein the main sheet guide portion is inclined approximately 45° from the bottom end portion.

* * * * *